United States Patent [19]

Sowards

[11] Patent Number: 4,720,095

[45] **Date of Patent: * Jan. 19, 1988**

[54] SPORTS TRAINING AND PRACTICE DEVICE

[76] Inventor: Gregory E. Sowards, Box 682, Carthage, Mo. 64836

[ * ] Notice: The portion of the term of this patent subsequent to Oct. 16, 2001 has been disclaimed.

[21] Appl. No.: 746,347

[22] Filed: Jun. 19, 1985

Related U.S. Application Data

[63] Continuation-in-part of Ser. No. 661,951, Oct. 10, 1984, abandoned.

[51] Int. Cl.[4] ..... A63B 69/00

[52] U.S. Cl. ..... 272/77; 273/413; 273/55 B; 273/58 C

[58] Field of Search ..... 272/76, 77, 78; 273/413, 26 R, 55 B, 55 R, 58 C, 183 R, 184 B, 411

[56] References Cited

U.S. PATENT DOCUMENTS

| | | | |
|---|---|---|---|
| 925,342 | 6/1909 | Johnson . | |
| 2,400,105 | 5/1946 | Costello | 272/78 |
| 2,435,864 | 2/1948 | Adams | 272/78 |
| 2,677,545 | 5/1954 | Ross | 272/78 |
| 3,022,072 | 2/1962 | Zinnow | 272/78 |
| 3,226,116 | 12/1965 | Klingler | 272/78 |
| 3,498,613 | 3/1970 | Dreyer | 273/95 |
| 3,836,146 | 9/1974 | Golomb | 273/25 |
| 4,050,693 | 9/1977 | Lichterman | 272/78 |
| 4,278,257 | 7/1981 | Garcia et al. | 273/58 C X |
| 4,462,599 | 7/1984 | Brown | 273/411 |
| 4,477,083 | 10/1984 | Sowards | 273/411 |
| 4,478,420 | 10/1984 | Sowards | 273/411 |
| 4,516,769 | 5/1985 | Kopp | 273/411 X |
| 4,561,661 | 12/1985 | Walker et al. | 273/411 |
| 4,576,379 | 3/1986 | Juhasz | 273/58 C X |
| 4,609,197 | 9/1986 | Vodin | 273/58 C X |

FOREIGN PATENT DOCUMENTS

| | | | |
|---|---|---|---|
| 432638 | 8/1926 | Fed. Rep. of Germany | 272/78 |
| 0183146 | 7/1922 | United Kingdom | 273/200 R |
| 0210218 | 1/1924 | United Kingdom | 273/200 R |

*Primary Examiner*—Robert A. Haffer
*Assistant Examiner*—Danton D. DeMille
*Attorney, Agent, or Firm*—Rogers, Howell, Moore & Haferkamp

[57] ABSTRACT

A soccer training and practice device comprising a ball-like target mounted to an anchor member for engaging the ground. The anchor member is preferably a helical coil that can be twisted into the ground. The ball-like target is mounted to the anchor member so that when the anchor member is anchored in the ground the ball is in position where it can be kicked by a person standing on the ground. The mounting means allowing the target to move but retaining the target in substantially its original position where it can be repeatedly kicked.

6 Claims, 13 Drawing Figures

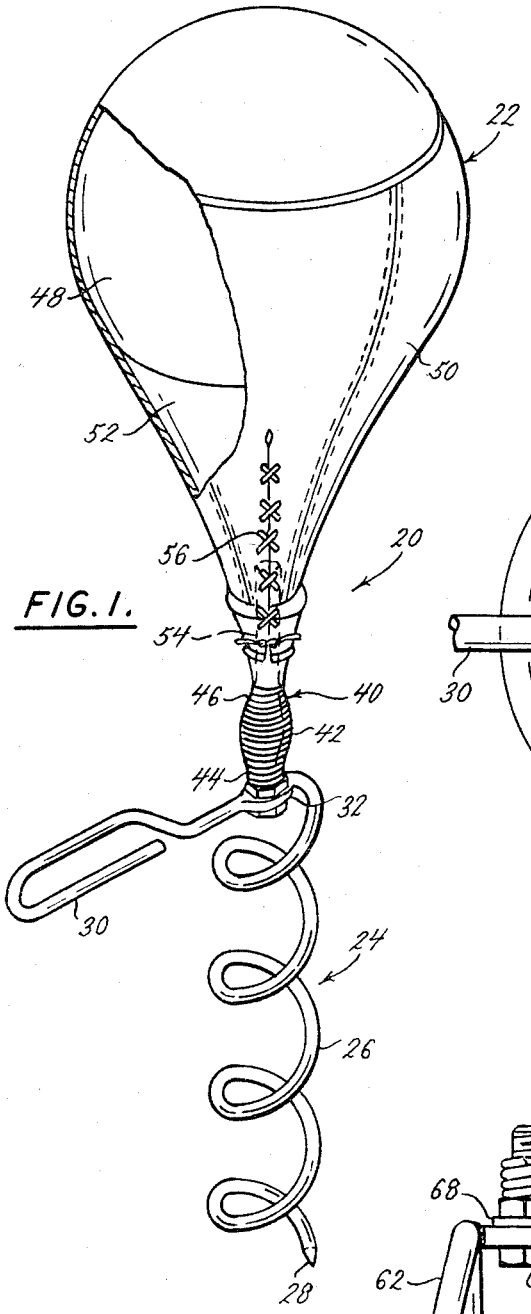
FIG. 1.
FIG. 2.
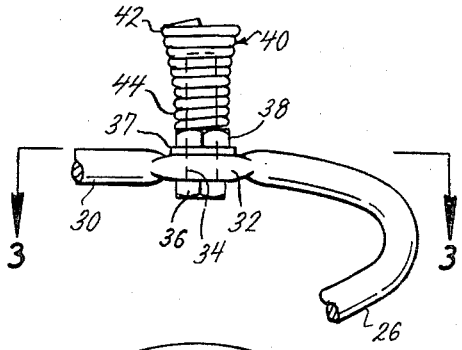
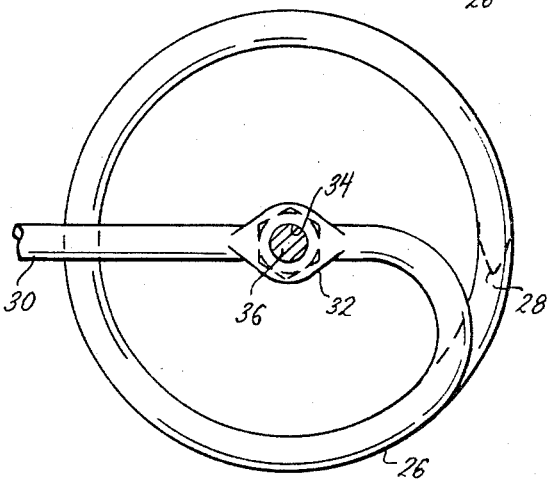
FIG. 3.
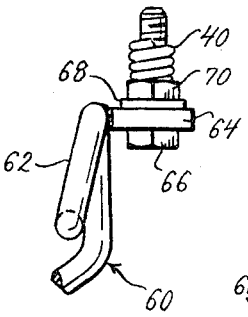
FIG. 5.
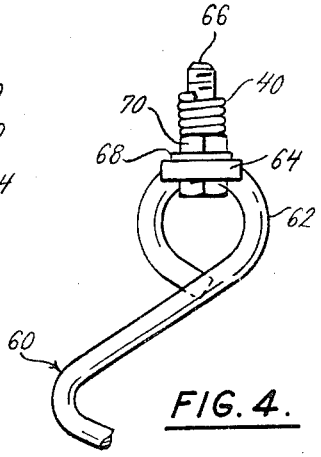
FIG. 4.

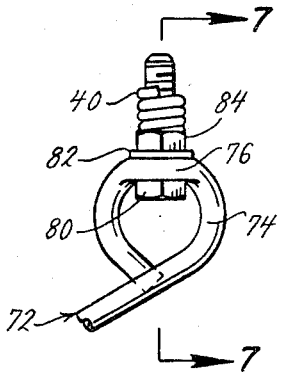
FIG. 6.
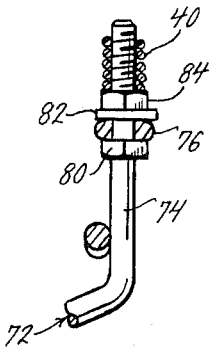
FIG. 7.
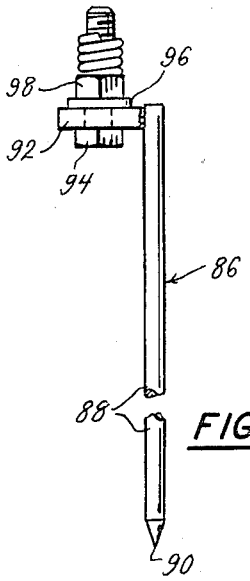
FIG. 8.
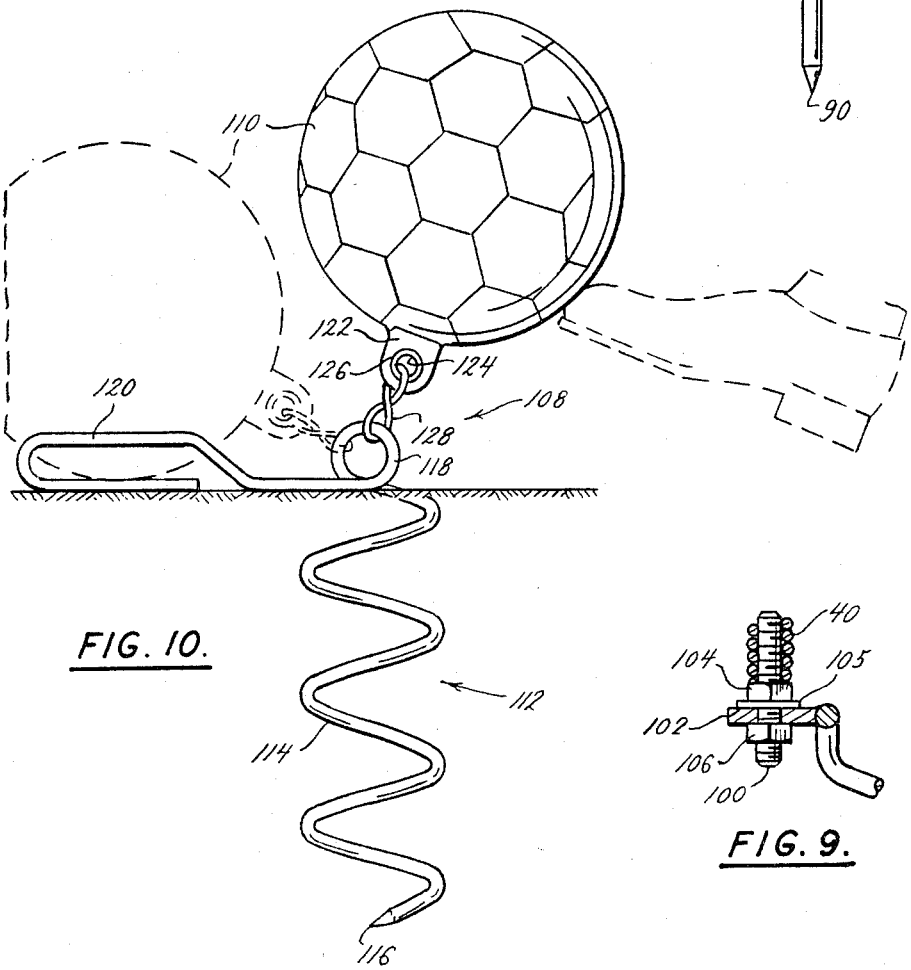
FIG. 10.
FIG. 9.

SPORTS TRAINING AND PRACTICE DEVICE

BACKGROUND AND SUMMARY OF THE INVENTION

This is a continuation-in-part of co-pending application Ser. No. 06/661,951, filed Oct. 10, 1984, now abandoned entitled SPORTS TRAINING AND PRACTICE DEVICE.

This invention relates to an athletic training and practice device and in particular to a device to develop and maintain the skills important to the play of soccer.

One prior art device for soccer training and practice involved tethering a soccer ball to an anchor in the ground with a length of elastic cord. This device presented several problems. This soccer ball and cord apparatus required a large flat area, which limited possible sites for use. The long cord posed a hazard because it could cause the user to trip. Finally, the elastic cord tether caused a fixed and slow return time that did not adequately prepare the user for real soccer play. The slowness of the tether system simply did not permit the user to develop the quickness and co-ordination crucial to the game.

Another prior art device was a resilient panel or backstop arranged vertically or at a near vertical angle against which the user kicked the ball. Like the soccer ball and cord apparatus, the backstop device required a large flat area which restricted possible sites for use. Since the ball was not tethered or otherwise contained, use was further restricted to areas where an escaped ball could cause no damage. Another problem was the support mechanism, which was prone to collapse. Finally, like the soccer ball and cord apparatus, the backstop device provided a slow return time that did not adequately prepare the user for real soccer play. The slowness of the backstop device simply did not permit the user to develop the quickness and coordination crucial to the game.

An example of an excellent training and practice device is the device disclosed in inventor's prior U.S. Pat. No. 4,478,420, issued Oct. 23, 1984, incorporated herein by reference. This device comprises a ball rebounder in communication with a playing surface formed by a trampoline. Resilient cords supported by collapsible safety poles about the periphery of the trampoline enclose the playing surface. The user positions himself on the playing surface and kicks the ball into the rebounder, which returns it to him. Escaped balls are contained on the playing surface by the resilient cords.

Another example of an excellent soccer training and practice device is that disclosed in inventor's prior U.S. Pat. No. 4,477,083 issued Oct. 16, 1984, incorporated herein by reference. This device comprises a bag resiliently mounted on an arm extending from the legs or frame of a trampoline. The trampoline provides a playing surface on which the user positions himself to kick the bag.

Still another example of an excellent sports training and practice device is that disclosed in inventor's co-pending application Ser. No. 661,951 filed Oct. 9, 1984, incorporated herein by reference. This device comprises a bag resiliently mounted directly to the frame of a trampoline. The trampoline again provides a playing surface on which the user positions himself to kick the bag.

Inventor's prior inventions all employ a trampoline as a playing surface. These devices can all be used in contained spaces, and do not employ a ball that can travel and cause damage. The devices allow the user to practice the skills important to the game of soccer. They provide a ball or ball-like target that the user can kick, and quickly return the ball or target to be kicked again. This allows the user to develop quickness and coordination.

The present invention is a new soccer training and practice device that provides many of the advantages of the inventor's prior inventions without requiring a trampoline. The present invention comprises an anchor member adapted to engage the ground. The anchor may have an integral handle to facilitate its installation, or a loop for releasably engaging a separate handle. An air bag is mounted to the top of the anchor member, in position where it can be kicked by a person standing on the ground, the mounting means permitting the air bag to move when kicked but retaining the air bag in substantially its original position, to allow it to be repeatedly kicked without requiring the user to reposition.

Thus, the device of this invention can be used in a small area, there is no ball that can escape and cause damage. The device provides a target that the user can repeatedly kick to develop quickness and coordination. Unlike the prior anchor and ball type device, the present device does not have a long cord that could cause the user to trip. Furthermore, the present device does not have the slow return time of the prior device, but keeps the target near the original position where it can be repeatedly kicked, providing better training.

BRIEF DESCRIPTION OF THE DRAWINGS

FIG. 1 is a perspective view of a first embodiment of a sports training and practice device constructed according to the principles of this invention;

FIG. 2 is a partial view of the device of claim 1 showing the mounting of the bag to the anchor;

FIG. 3 is a partial cross-sectional view of the device taken along the plane of line 3—3, showing the mounting of the bag to the anchor;

FIG. 4 is a partial side view of the sports training and practice device showing an alternate mounting of the bag to the anchor;

FIG. 5 is a partial front view of the device of FIG. 4;

FIG. 6 is a partial side view of the sports training and practice device, showing an alternate mounting of the bag to the anchor;

FIG. 7 is a front view of the device of FIG. 6;

FIG. 8 is a side view of the sports training and practice device showing an alternate anchor;

FIG. 9 is a side view of the sports training and practice device showing an alternate mounting of the bag to the anchor;

FIG. 10 is a side view of a second embodiment of a sports training and practice device showing an alternate mounting of the bag to the anchor;

DETAILED DESCRIPTION OF THE PREFERRED EMBODIMENT

Figure 11:
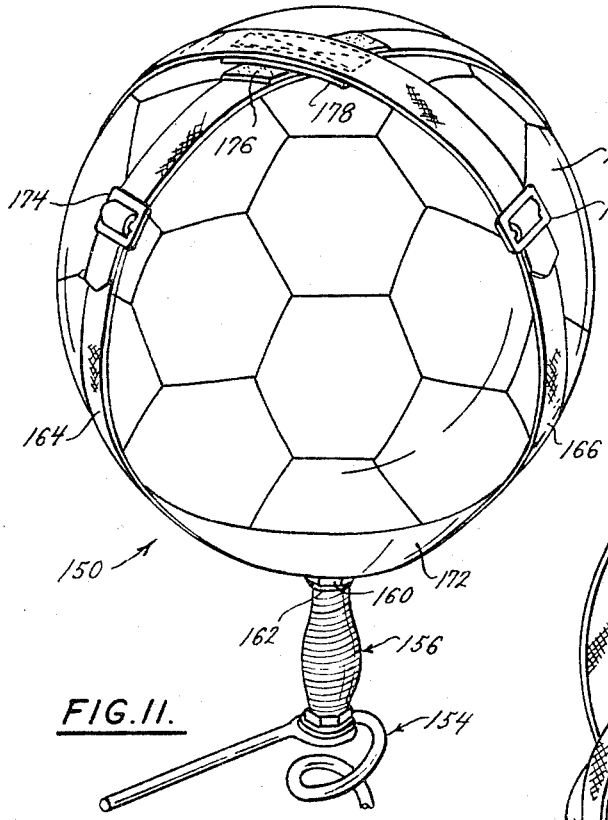
FIG. 11 is a perspective view of the sports training and practice device showing means to mount and use a regular soccer ball as the target.
Figure 13:
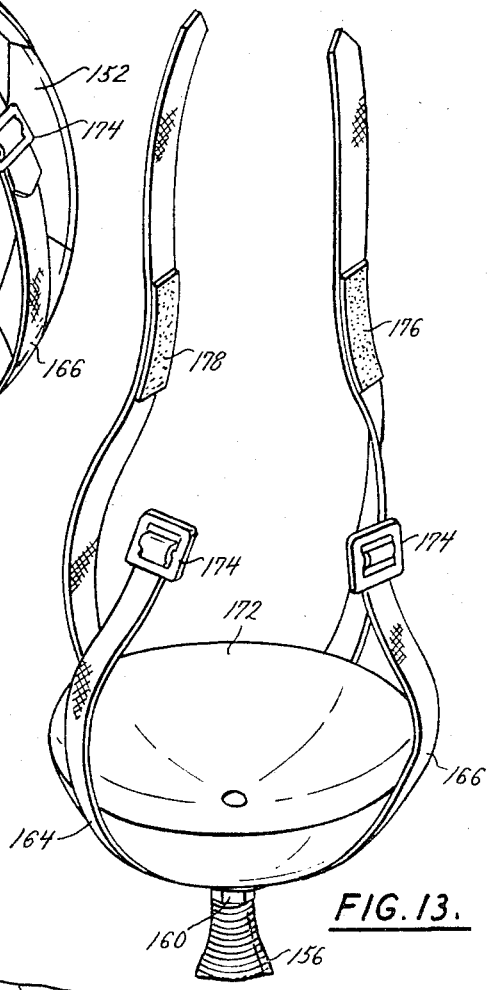
FIG. 13 is a perspective view of the structure for mounting the soccer ball shown in FIG. 11.

A sports training and practice device constructed according to the principles of this invention, indicated generally as 20 in FIG. 1, is shown as comprising air bag 22 and anchor 24. Air bag 22 could also be some other target means such as an airfilled ball, a foam ball, or otherwise, but it will be referred to generally herein as bag 22.

As best shown in FIG. 1, anchor 24 has a helically wound lower portion 26 with a pointed tip 28 on the bottom to facilitate the insertion of anchor 24 into the ground. A handle portion 30 extends generally horizontally from the top of anchor 24, and loops back on itself. Handle portion 30 makes it easier to twist anchor 24 into the ground. The loop in handle 30 makes it easier to grasp, especially as the bottom of the loop nears the ground. As best shown in FIGS. 2 and 3, anchor 24 has a flattened portion 32 with a hole 34 extending through it. A bolt 36 extends upwardly through hole 34 in flattened portion 32, with the threaded portion of bolt 36 protruding above the top of anchor 24. A washer 37 (optional) and nut 38 on bolt 36 secures bolt 36 to anchor 24 with a significant portion of the threaded section extending upwardly above anchor 24.

A coil spring 40 preferably of the type having a bulbous mid-section 42 and a tapering bottom 44 and top 46, is mounted on bolt 36. Bottom 44 of spring 40 is fitted over the threaded section of bolt 36, the lower coils of spring 40 effecting a tight engagement of bolt 36.

Top 46 of spring 40 is attached to bag 22, which is similar to a punching bag. As shown in FIG. 1, a ball-shaped air-filled rubber bladder 48 is disposed in the bulb of a teardrop shaped cover 50. A rubber cone 52 having an axial bore 54 is provided in the neck of teardrop shaped cover 50. Laces 56 secure cover 50, holding bladder 48 and cone 52 in abutment. A hose clamp (not shown) can also be installed around the neck of cover 50 to secure it. Top 46 of spring 40 is received in bore 56 of rubber cone 52.

Of course, any other spring means could be used to resiliently mount bag 22 to anchor 24. For example, a bag structure similar to that just described could be provided except rubber cone 52 could be provided with a downward extension or foot which protrudes through the bottom of teardrop shaped cover 50. This foot can then be mounted directly to bolt 36 to resiliently mount bag 22 without coil spring 40.

A first alternate anchor 60 and mounting means is shown in FIGS. 4 and 5. Anchor 60 has a helically wound portion with a pointed tip at the bottom (not shown) like anchor 24. However, at the top, anchor 60 has a loop 62 for temporarily receiving a handle. A handle makes it easier to twist anchor 60 into the ground. A base 64 is attached on the side of loop 62 near the top, as by welds. Base 64 has a hole in it through which bolt 66 extends upwardly with the treaded portion of bolt 66 protruding above the top of anchor 60. A washer 68 (optional) and nut 70 secure bolt 66 to base 64 with a significant portion of the threaded section extending upwardly above anchor 60. As shown in FIGS. 4 and 5, the coils of a spring 40 for mounting bag 22 can be mounted over bolt 60, exactly as described above with regard to bolt 36.

A second alternate anchor 72 and mounting means is shown in FIGS. 6 and 7. Anchor 72 has a helically wound portion with a pointed tip at the bottom (now shown) like anchor 24. However, at the top, anchor 72 has a loop 74 for temporarily receiving a handle. A handle makes it easier to twist anchor 72 into the ground. The top of loop 74 has a flattened portion 76, with a hole 78 extending through it. A bolt 80 extends upwardly through hole 78 with the threaded portion of bolt 80 protruding above the top of anchor 72. A washer 82 (optional) and nut 84 secure bolt 80 to anchor 72 with a significant portion of the threaded section extending upwardly above anchor 72. As shown in FIGS. 6 and 7, the coils of a spring 40 for mounting a bag 22 can be mounted over bolt 80, exactly as described above with regard to bolt 36.

A third alternate anchor 86 and mounting means is shown in FIG. 8. Anchor 86 has an elongated blade portion 88 with a pointed tip 90 on the bottom to facilitate the insertion of anchor 86 into the ground. Blade portion 88 can have a curve in it to facilitate anchoring. A base 92 is attached on the side of anchor 86 near the top as by welds. Base 92 has a hole in it through which a bolt 94 extends upwardly with the threaded portion of bolt 94 protruding above the top of anchor 86. A washer 96 (optional) and nut 98 secure bolt 94 to base 92 with a significant portion of the threaded section extending upwardly above anchor 86. As shown in FIG. 8, the coils of a spring 40 for mounting bag 22 can be mounted over bolt 94, exactly as described above with regard to bolt 36.

FIG. 9 illustrates an alternate method of mounting bag 22. Instead of mounting spring 40 onto a bolt, as previously described, a threaded stud 100 is used. Stud 100 is mounted to a base, such as base 102 in FIG. 9, with nut 104 and washer 105 above base 102, and nut 106 below base 102. Spring 40 can be mounted onto the top of stud 100. This mounting method allows bag 22 to be removed from base 102 without removing spring 40 from stud 100. Instead, nut 106 can simply be removed from stud 100 and stud 100 with bag 22 attached, can be removed. Bag 22 can thus be used for some other purpose, for example it can be mounted to a trampoline according to inventor's prior U.S. Pat. No. 4,477,083 or the invention disclosed in copending application Ser. No. 661,951 filed Oct. 9, 1984. Alternatively, bolt 104 can be welded to base 102, or base 104 can be threaded so that stud 100 can be directly threaded into or out of base 102. In still another alternative the hole in top of any anchor members described can be provided with a nut welded in alignment therewith, or the hole can be threaded, to receive stud 100 directly.

A second embodiment of a soccer training and practice device constructed according to the principles of this invention, indicated generally as 108 in FIG. 10, is shown as comprising ball 110 and anchor 112. Anchor 112 has helically wound lower portion 114 with a pointed tip 116 on the bottom to facilitate the insertion of anchor 112 into the ground. Anchor 112 has a loop 118 formed in its upper portion. A handle portion 120, like handle 30 described above, extends generally horizontally from loop 118. Handle portion 120 makes it easier to twist anchor 112 into the ground. Instead of providing handle portion 120, a handle can be temporarily inserted into loop 118 to make it easier to twist anchor 112 into the ground.

Ball 110 has a tag 122 having a hole 124 therein protected with grommet 126. A FIG. 8 link 128 extends between hole 124 and loop 118, securing ball 110 to anchor 112.

Figure 12:
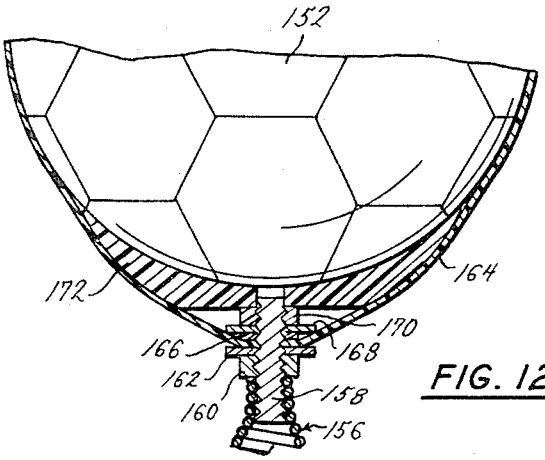
FIG. 12 is a partial cross-sectional view of the structure for mounting the soccer ball shown in FIG. 11.

FIG. 11 shows an alternate device 150 employing a regular soccer ball 152 as the target. The device 150 comprises an anchor 154 which can be any of the anchors previously described. A coil spring 156, like spring 40 previously described, is mounted to anchor 154. A threaded stud 158 extends from the top of spring 156 and as best seen in FIG. 12 nut 160, washer 162, strap 164, strap 166, washer 168, nut 170, and rubber cup 172 are mounted on the portion of stud 158 extending above the top of spring 156.

Soccer ball 152 is mounted in cup 172, and straps 164 and 166 are secured around ball 152, as with buckles 174 to retain the soccer ball 152. Straps 162 and 166 are preferably at right angles to each other. Mating portions 176, 178 of a hook and loop type fastening material can be mounted on straps 164 and 166 to secure the straps to each other.

This embodiment allows the user to quickly, easily and releasably mount his own soccer ball to the device for soccer training and practice.

OPERATION

The soccer training and practice device of this invention is installed into the ground by twisting the anchor into the ground, if it is a helical-type or driving it into the ground if it is a blade-type. If the anchor has an integral handle, this can be used to help twist the anchor, otherwise a handle can be inserted into a loop in the anchor to help twist the anchor.

In the devices or the first embodiment, the balls are resiliently mounted in a generally upright Position to the anchor. The user stands near the device and kicks the bag which is quickly returned to substantially its original position where it can be repeatedly kicked without the user having to reposition.

In the device of the second embodiment, the ball is fixedly mounted to the anchor. The user stands near the device and kicks the ball which can move, but which remains substantially in its original position where it can be repeatedly kicked without the user having to reposition. Preferably, the link is sufficiently long, as shown in FIG. 10 to allow ball 110 to bounce off the ground and return back to the kicker in a kind of dribbing motion.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

I claim:

1. A soccer training and practice device comprising:

an anchor member, said anchor member having means for securing said member to a foundation and including a helical coil to facilitate its being twisted into and out of the foundation;

a ball-like target adapted for being kicked from various directions with a typical soccer dribbling motion; and means for resiliently mounting the target to substantially the top of the anchor, said resilient mounting means supporting said target in a generally upright orientation substantially adjacent the foundation so that it can be kicked by a person standing on the foundation with a typical soccer dribbling motion, the resilient mounting means restoring the target to its original upright orientation and position after the target is displaced.

2. The soccer training and practice device of claim 1 further comprising a handle mounted near the top of the anchor member for use in twisting the anchor member into and out of the foundation.

3. A soccer training practice device comprising:

an anchor member, said anchor member having means for securing said member to a foundation;

said anchor member having a bottom portion that is helically coiled for insertion into the foundation and an integral handle portion at the top extending generally perpendicular to the axis of the helical coil, said handle being used during the mounting and removal of the anchor;

an air bag for kicking from various directions with a typical soccer dribbling motion comprising a teardrop shaped cover;

an air filled rubber bladder disposed in the bulb of the cover;

a cone in the neck of the cover abutting the air filled bladder;

a spring means mounted to the air bag; and means for attaching the spring means to substantially the top of the anchor member, said spring means resiliently mounting and supporting the air bag in a generally upright orientation substantially adjacent the foundation so that it can be kicked by a person standing on the foundation with a typical soccer dribbling motion, the spring means restoring the air bag to its original upright orientation and position after the air bag is displaced.

4. A soccer training and practice device comprising:

an anchor member, said anchor member including a stake portion to be removably mounted substantially entirely in the ground for securely the stake thereto;

a ball-like target adapted for being kicked from various directions with a typical soccer dribbling motion; and means for resiliently mounting the target to substantially the top of the anchor, said resilient mounting means supporting said target in a generally upright orientation substantially adjacent the ground and in position relative to the ground to be kicked by a person standing on the ground with a typical soccer dribbling motion, the resilient mounting means imparting a swinging motion to the target when kicked and restoring the target to its original upright orientation and position after the target is displaced.

5. The soccer training and practice device of claim 4 wherein the resilient mounting means further comprises a coil spring.

6. A soccer training and practice device comprising:

a helical coil anchor, said anchor being adapted to screw substantially entirely into the ground, said anchor having a handle portion extending radially from the top thereof generally perpendicular to the axis of the coil, the handle extending substantially beyond the radius of the coil to facilitate screwing the anchor into or out of the ground, the anchor having a hole formed in its top;

a threaded mounting stud extending through said hole;

a coil-like spring mounted over said threaded stud;

a ball-like target adapted for being kicked from various directions with a typical soccer dribbling motion; and means for mounting the target to the spring in a generally upright orientation, said spring being dimensioned to mount the target substantially adjacent the ground so that it can be kicked by a person standing on the ground with a typical soccer dribbling motion.

* * * * *